US005136971A

United States Patent [19]

Blankemeyer et al.

[11] Patent Number: 5,136,971

[45] Date of Patent: Aug. 11, 1992

[54] APPARATUS FOR TRANSPORTING ARTICLES

[75] Inventors: James C. Blankemeyer, Columbus Grove; James E. Burkholder; James C. Miller, both of Lima, all of Ohio

[73] Assignee: MetoKote Corporation, Lima, Ohio

[21] Appl. No.: 634,475

[22] Filed: Dec. 27, 1990

[51] Int. Cl.[5] ..... B05C 5/02

[52] U.S. Cl. ..... 118/324; 198/678.1

[58] Field of Search ..... 118/324, 239; 198/678.1, 469.1

[56] References Cited

U.S. PATENT DOCUMENTS

| | | | |
|---|---|---|---|
| 3,353,515 | 11/1967 | Stolle et al. | 118/324 X |
| 3,356,061 | 12/1967 | Wiggins | 118/682 |
| 3,472,354 | 10/1969 | Locatelli | 198/465.3 |
| 3,779,361 | 12/1973 | Schmitt | 198/468.1 |
| 3,854,445 | 12/1974 | Stolle et al. | 118/324 X |
| 4,009,301 | 2/1977 | Heckman et al. | 118/324 X |
| 4,220,240 | 9/1980 | Norberg et al. | 198/408 |
| 4,380,964 | 4/1983 | Abe et al. | 118/50 |
| 4,462,315 | 7/1984 | Wakabayashi | 134/45 X |
| 4,538,542 | 9/1985 | Kennon et al. | 118/324 X |
| 4,691,640 | 9/1987 | Murai | 118/324 X |
| 4,881,488 | 11/1989 | Fantacci | 118/324 X |

*Primary Examiner*—Richard L. Chiesa

*Attorney, Agent, or Firm*—Killworth, Gottman, Hagan & Schaeff

[57] ABSTRACT

An apparatus is provided which includes a conveyor for conveying a plurality of fixtures, each of which supports one or more articles thereon, along a predetermined conveying path. A processing station, such as a spraying station, is provided near a first section of the conveying path. A rotatable chuck, supported upon a carriage, is positioned adjacent to the first section and serves to successively transfer each of the fixtures from the conveyor to the spraying station, and to return each of the fixtures after spraying back to the conveyor.

22 Claims, 15 Drawing Sheets

APPARATUS FOR TRANSPORTING ARTICLES

BACKGROUND OF THE INVENTION

The present invention generally relates to an apparatus for transporting articles which are acted upon in at least one processing station and, more particularly, to such an apparatus which transfers the articles from an endless conveyor to the processing station and back to the endless conveyor.

Apparatus for transporting articles which are acted upon in at least one processing station are known in the art. For example, U.S. Pat. No. 3,356,061 describes an apparatus comprising an endless conveyor having a number of regularly spaced pendants, each of which is adapted to receive an article hanger supporting an article. The endless conveyor is continuously driven to permit the conveyor to move the articles past a set of spray guns, which serve to spray coat the articles. Because this apparatus does not provide a mechanism for rotating articles during spraying, this apparatus is disadvantageous for coating articles having irregular outer surfaces. Furthermore, because the articles are vertically oriented during spraying rather than being horizontally oriented, the quality of the surface finish on each completed workpiece may be less than satisfactory.

A further apparatus for transporting articles which are acted upon in at least one processing station is known in the art. This apparatus comprises a rotatable ring carrier which vertically supports a plurality of workpieces thereon and transfers the workpieces through a spraying station and into a curing station. This apparatus is also disadvantageous because it does not provide for workpiece rotation during spraying, and the workpieces are vertically oriented rather than being horizontally oriented during spraying.

Accordingly, a need exists for an alternative apparatus for transporting articles which are acted upon in at least one processing station. An approach is desired in which the apparatus permits each workpiece to be horizontally oriented and while being acted upon in a processing station.

SUMMARY OF THE INVENTION

This need is met by the apparatus of the present invention which includes a conveyor for conveying a plurality of fixtures, each of which supports one or more articles thereon, along a predetermined conveying path. A processing station, such as a spraying station, is provided near a first section of the conveying path. A rotatable chuck, supported upon a carriage, is positioned adjacent to the first section and serves to successively transfer each of the fixtures from the conveyor to the spraying station, and return each of the fixtures after spraying back to the conveyor.

In accordance with one aspect of the present invention, an apparatus is provided for transporting articles which are acted upon in at least one processing station. The apparatus comprises a plurality of fixtures, each for supporting at least one article thereon. Endless conveyor means are provided for conveying each of the fixtures along a predetermined conveying path, a first section of which is positioned proximate to a first processing station. Transfer means are positioned adjacent to the first section of the conveying path for successively transferring each of the fixtures from the endless conveyor means to the first processing station to permit at least one article supported upon each fixture to be acted upon in the processing station, and returning each of the fixtures from the processing station to the conveyor means after at least one article on each fixture has been acted upon in the processing station.

The apparatus preferably further includes second and third processing stations. The first processing station may comprise a spraying station, the second processing station may comprise a pre-heating station and the third processing station may comprise a curing station. The conveying path further includes a second section which extends through the pre-heating station and a third section which extends through the curing The transfer means preferably comprises: chuck means for engaging with and transferring each of the fixtures successively from the endless conveyor means to the first processing station, and returning each of the fixtures from the first processing station to the conveyor means; carriage means for supporting the chuck means and moving the chuck means along first, second and third mutually perpendicular axes so as to permit the chuck means to engage with and transfer each of the fixtures from the conveyor means to the first processing station, and return each of the fixtures from the first processing station to the conveyor means; first reciprocating means connected to the carriage means for moving the carriage means along the first axis; second reciprocating means connected to the first reciprocating means for moving the first reciprocating means and the carriage means along the second axis; and elevator means connected to the second reciprocating means for moving the first and second reciprocating means and the carriage means along the third axis.

The first reciprocating means preferably comprises first linear bearing means connected to the carriage means for supporting the carriage means and allowing the carriage means to reciprocate in and out along the first axis, and first rack and pinion drive means for reciprocating the carriage means in and out along the first linear bearing means. The second reciprocating means preferably comprises second linear bearing means for supporting the first reciprocating means and the carriage means and allowing the first reciprocating means and the carriage means to reciprocate back and forth along the second axis, and second rack and pinion drive means for reciprocating the first reciprocating means and the carriage means back and forth along the second linear bearing means. The elevator means preferably comprises a frame connected to the second reciprocating means for supporting the first and second reciprocating means and the carriage means, and drive means connected to the frame for reciprocating the frame, the first and second reciprocating means and the carriage means up and down along the third axis.

The chuck means preferably comprises a mandrel having a centrally located longitudinal axis, and means associated with the mandrel for locking one of the fixtures thereto. The transfer means further comprises means for rotating the mandrel about its centrally located longitudinal axis.

The conveyor means comprises an endless conveyor chain, and means for transferring the endless conveyor chain along the conveying path.

In accordance with a second aspect of the present invention, an apparatus is provided for transporting articles which are acted upon in at least one processing station. The apparatus comprises a plurality of fixtures, each for supporting at least one article thereon. Endless conveyor means are provided for conveying each of the fixtures along a conveying path, a first section of the conveying path being positioned proximate to a first processing station. Transfer means are positioned adjacent to the first section of the conveying path for transferring each of the fixtures one at a time from the endless conveyor means to the first processing station to permit the article supported upon each respective fixture to be acted upon in the processing station, and returning each of the fixtures from the processing station to the conveyor means after the article on each respective fixture has been acted upon at the processing station.

The apparatus preferably further includes second and third processing stations. The first processing station may comprise a spraying station, the second processing station may comprise a pre-heating station and the third processing station may comprise a curing station. The conveying path further includes a second section which extends through the pre-heating station and a third section which extends through the curing station.

The transfer means may comprise chuck means, carriage means, first and second reciprocating means and elevator means as described above with respect to the first aspect of the present invention.

The conveyor means preferably comprises an endless conveyor chain, and means for transferring the endless conveyor chain along the conveying path.

Accordingly, it is an object of the present invention to provide an apparatus for transporting articles which are acted upon in at least one processing station. It is additionally an object of the present invention to provide an apparatus which permits fixtures having workpieces support thereon to be rotated as they pass through pre-heating and curing stations. This ensures that the workpieces are evenly heated as they pass through the two stations. It is further an object of the present invention to provide an apparatus which is capable of horizontally orienting and rotating each workpiece while it is being acted upon in a spray coating station. This, and other objects and advantages of the present invention, will become apparent from the following detailed description, the accompanying drawings, and the appended claims.

DETAILED DESCRIPTION OF THE INVENTION

Figure 1:
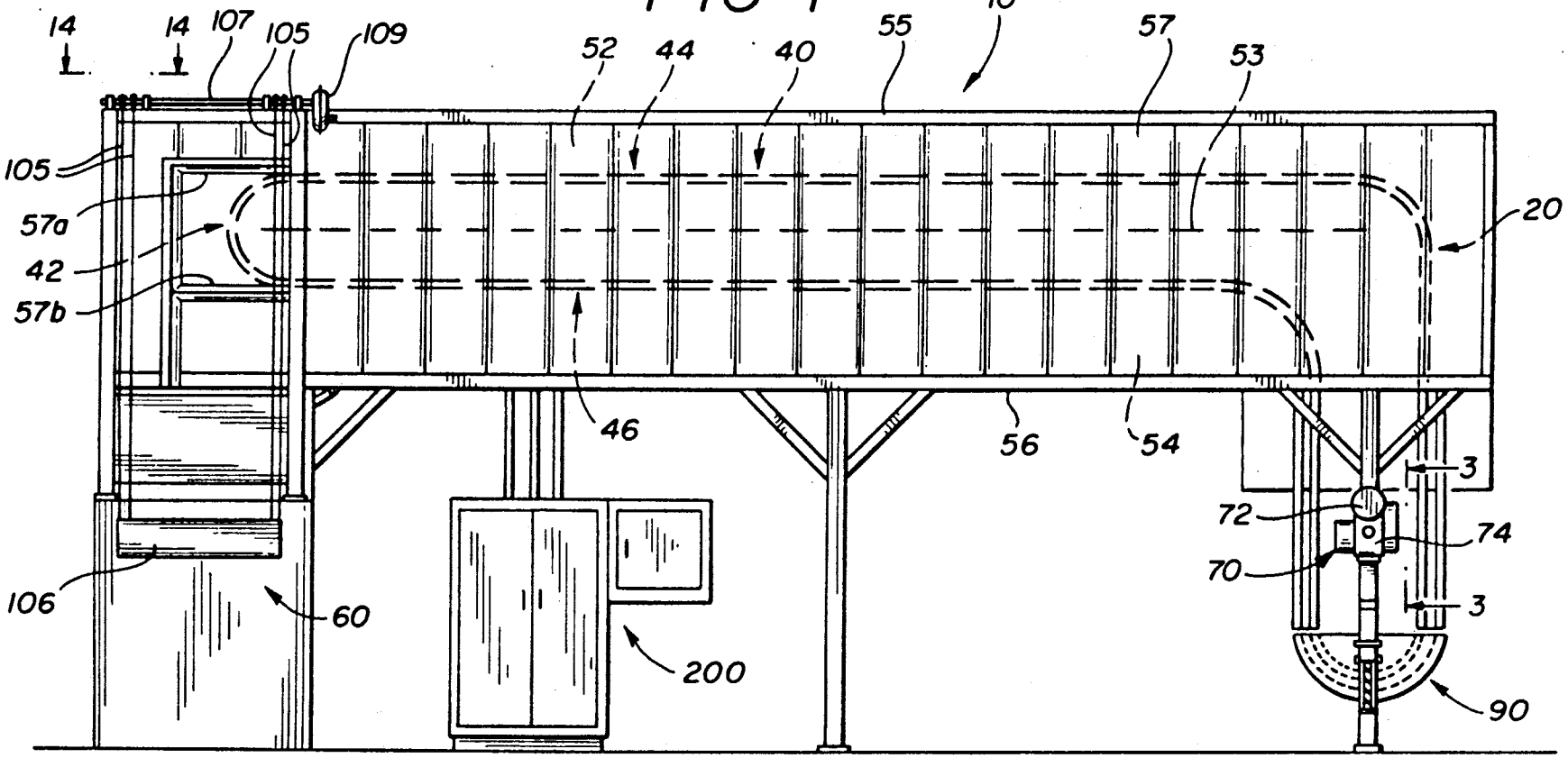
FIG. 1 is a side elevational view of the transporting apparatus of the present invention with parts of the conveyor drive means not shown.
Figure 2:
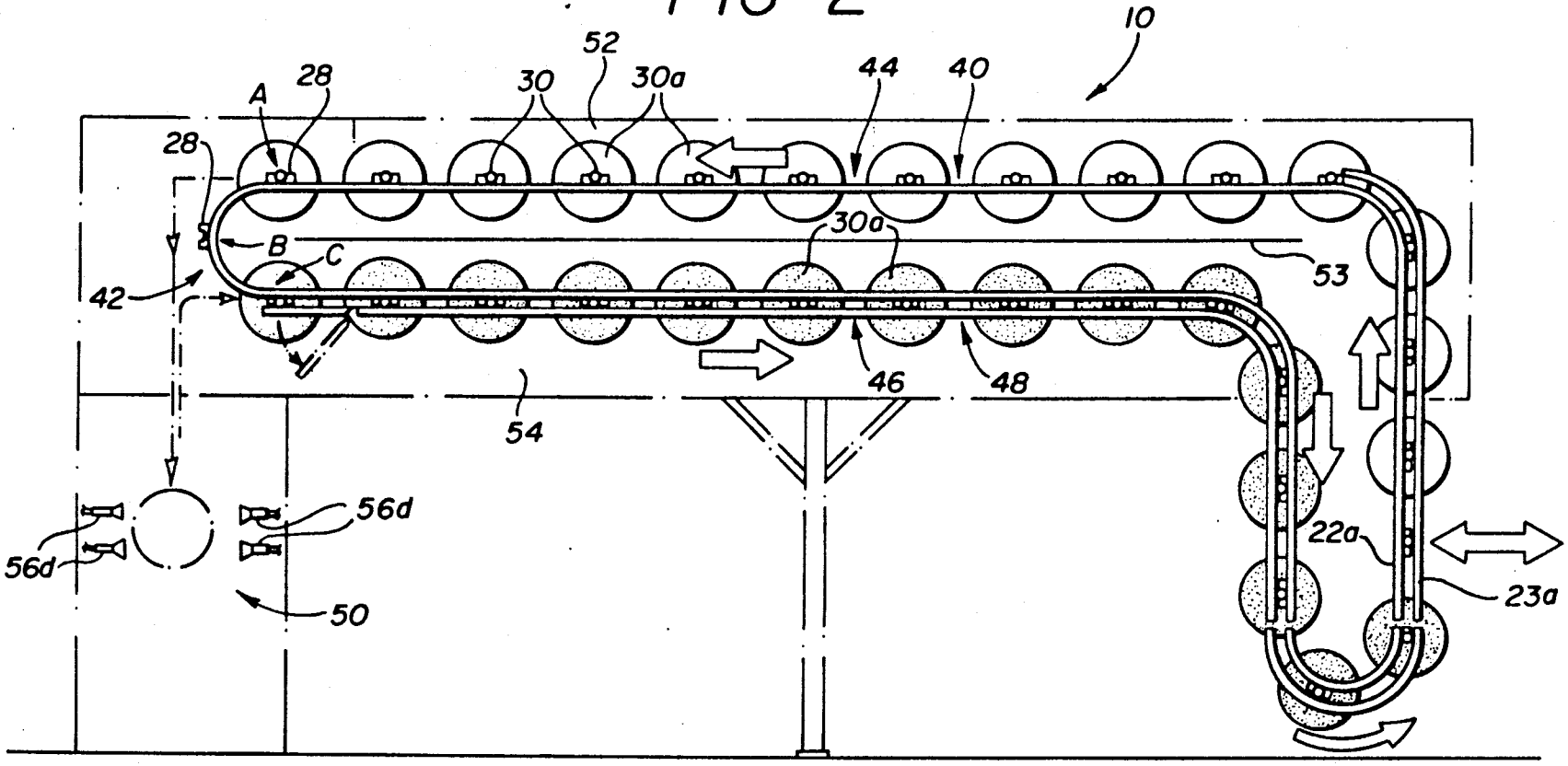
FIG. 2 is a side elevational view of the conveyor means having a plurality of fixtures thereon, and with the transfer means removed to show schematically the first processing station.

A side elevational view of the transporting apparatus of the present invention, generally designated by reference numeral 10, is shown in FIG. 1 The apparatus 10 includes an endless conveyor means 20 which serves to convey a plurality of fixtures 30, shown in FIG. 2, along an endless conveying path 40. A first section 42 of the conveying path 40 is positioned above a first processing station 50, shown schematically in FIG. 2, which may comprise an electrostatic powder coating spray station. A second section 44 of the conveying path 40 extends through a second processing station, which may comprise a pre-heating station 52, and a third section 46 of the conveying path 40 extends through a third processing station, which may comprise a curing station 54. A transfer means 60 is positioned below and to the side of the first section 42 of the conveying path 40 and to the side of the first processing station 50 and serves to successively transfer each of the fixtures 30 from the endless conveyor means 20 to the first processing station 50 to permit articles 30*a*, represented schematically in the Figures as cylindrical objects, supported upon each fixture 30 to be acted upon in the first processing station 50, and to return each of the fixtures 30 from the first processing station 50 to the conveyor means 20 after the articles 30a on each fixture 30 have been acted upon in the first processing station 50.

As shown in FIG. 1, the pre-heating station 52 is positioned above the curing station 54 and is separated therefrom by a dividing plate 53. The pre-heating station 52 and the curing station 54 are enclosed by upper and lower plates 55 and 56, respectively, and by side plates 57. Preferably, heating elements (not shown) are included within the stations 52 and 54 for maintaining the stations 52 and 54 at appropriate temperatures for pre-heating and curing.

Referring to FIGS. 3-7, the conveyor means 20 includes two sets of track sections 22a and 22b, which define the conveying path 40. The conveyor means 20 also comprises two endless conveyor chains 24a and 24b, each of which is located within one of the two track sections 22a and 22b. Each conveyor chain 24a and 24b comprises a plurality of links 25 which are joined to one another by pins 26. Located on opposite sides of each pin 26 are bearing rollers 27, which permit the chains 24a and 24b to travel through the track sections 22a and 22b and along the conveying path 40.

Each chain 24a and 24b also includes a plurality of yokes 28 fixedly attached thereto. Each yoke 28 includes an inner recess 28a which serves to receive an end portion 32 of a fixture 30. The bottom radius of each recess 28a is positioned below an upper portion 22a' or 22b' of its associated track section 22a or 22b. This allows the end portions 32 of the fixtures 30 to be in contact with the upper portions 22a' and 22b' of the track sections 22a and 22b as the fixtures 30 pass through the pre-heating station 52 and the curing station 54. Since the end portions 32 of the fixtures 30 are in contact with the top portions 22a' and 22b', the fixtures 30 are caused to rotate as they travel along the track sections 22a and 22b through the pre-heating station 52 and the curing station 54. This ensures that the articles 30a located on the fixtures 30 are evenly heated as they pass through the preheating station 52 and the curing station 54 and prevents any one article from being exposed for a prolonged period of time to one or more heating elements which could cause the part to be overheated as it travels through the stations 52 and 54.

Positioned directly across from the track sections 22a and 22b, along a portion 48 of the conveying path 40, are article support tracks 23a and 23b. The tracks 23a and 23b serve to support and guide the end portions 32 of the fixtures 30 as they travel along the portion 48 of the conveying path 40.

Figure 8:
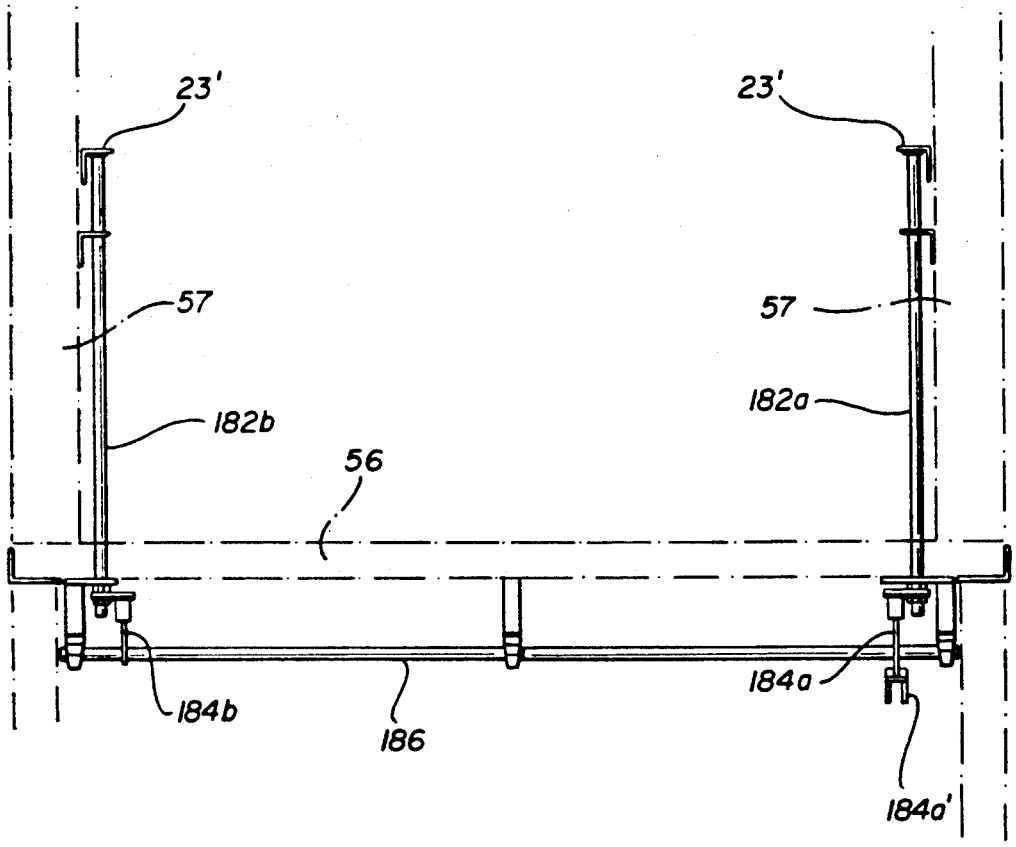
FIG. 8 is an end view of the two pivotable sections associated with the two support tracks, with the corresponding adjacent sections of the two pivotable sections and the piston-cylinder arrangement not shown.
Figure 9:
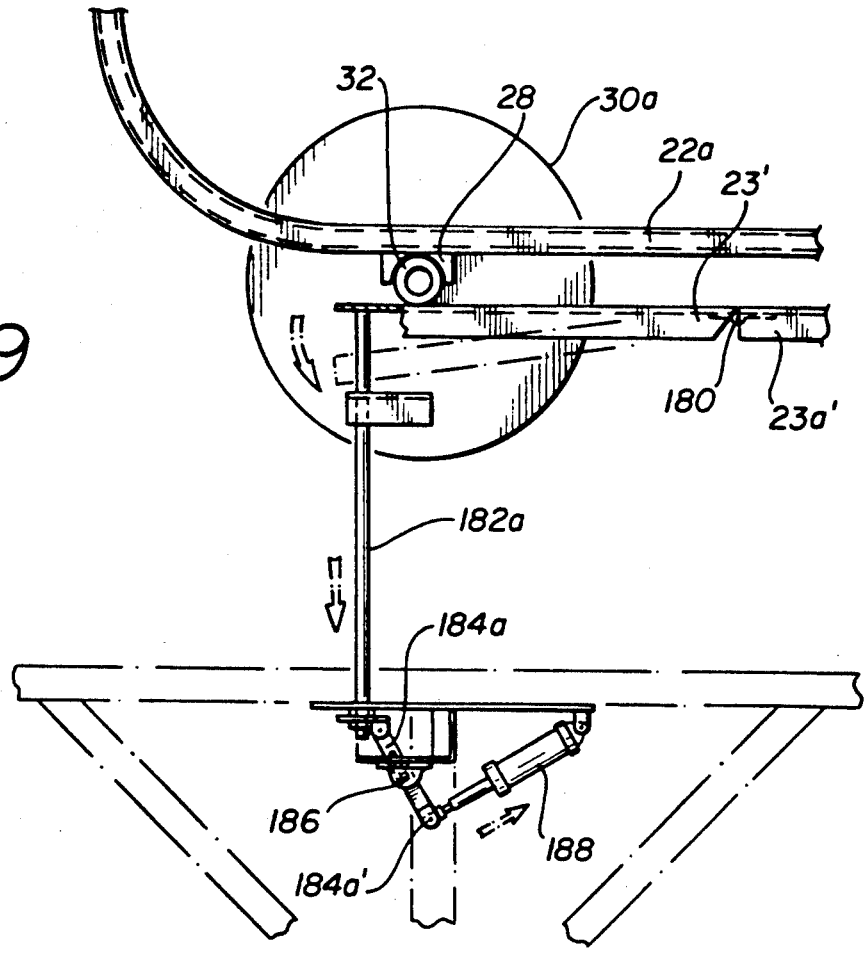
FIG. 9 is a side view of one of the two pivotable sections shown in FIG. 8, with its corresponding adjacent section and the piston-cylinder arrangement shown.
Figure 10:
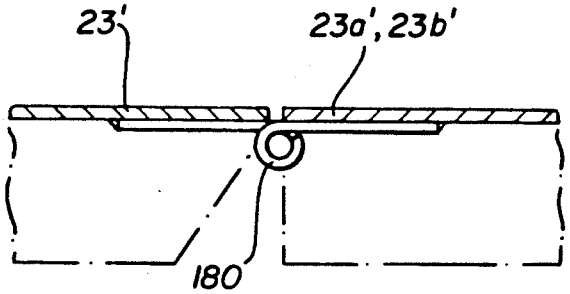
FIG. 10 is an enlarged view of a pivotable section shown in FIG. 8 joined to its corresponding adjacent section.

Each support track 23a and 23b includes a pivotable section 23', best shown in FIGS. 8-10, which allows a fixture 30, after its workpieces 30a have been acted upon in the first processing station 50, to be returned to the conveyor means 20. Each section 23' is joined to its corresponding adjacent section 23a' or 23b' by a pivotable hinge 180, and is caused to pivot about its respective hinge 180 by an associated reciprocating drive rod 182a or 182b. Drive rod 182a is connected at its ends to its respective section 23' and a pivotable lever 184a, while drive rod 182b is connected at its ends to its respective section 23' and a pivotable lever 184b. Levers 184a and 184b are fixedly mounted upon a rotatable shaft 186b. Lever 184a is further connected to a piston-cylinder arrangement 188 by a yoke 184a' located on the lever 184a. When the piston-cylinder arrangement 188 is actuated, it acts to pivot lever 184a which, in turn, causes shaft 186 and lever 184b to rotate therewith. This results in both sections 23' being moved toward or away from the track sections 22a and 22b to allow a fixture 30 to be returned to the conveyor means 20.

Figure 3:
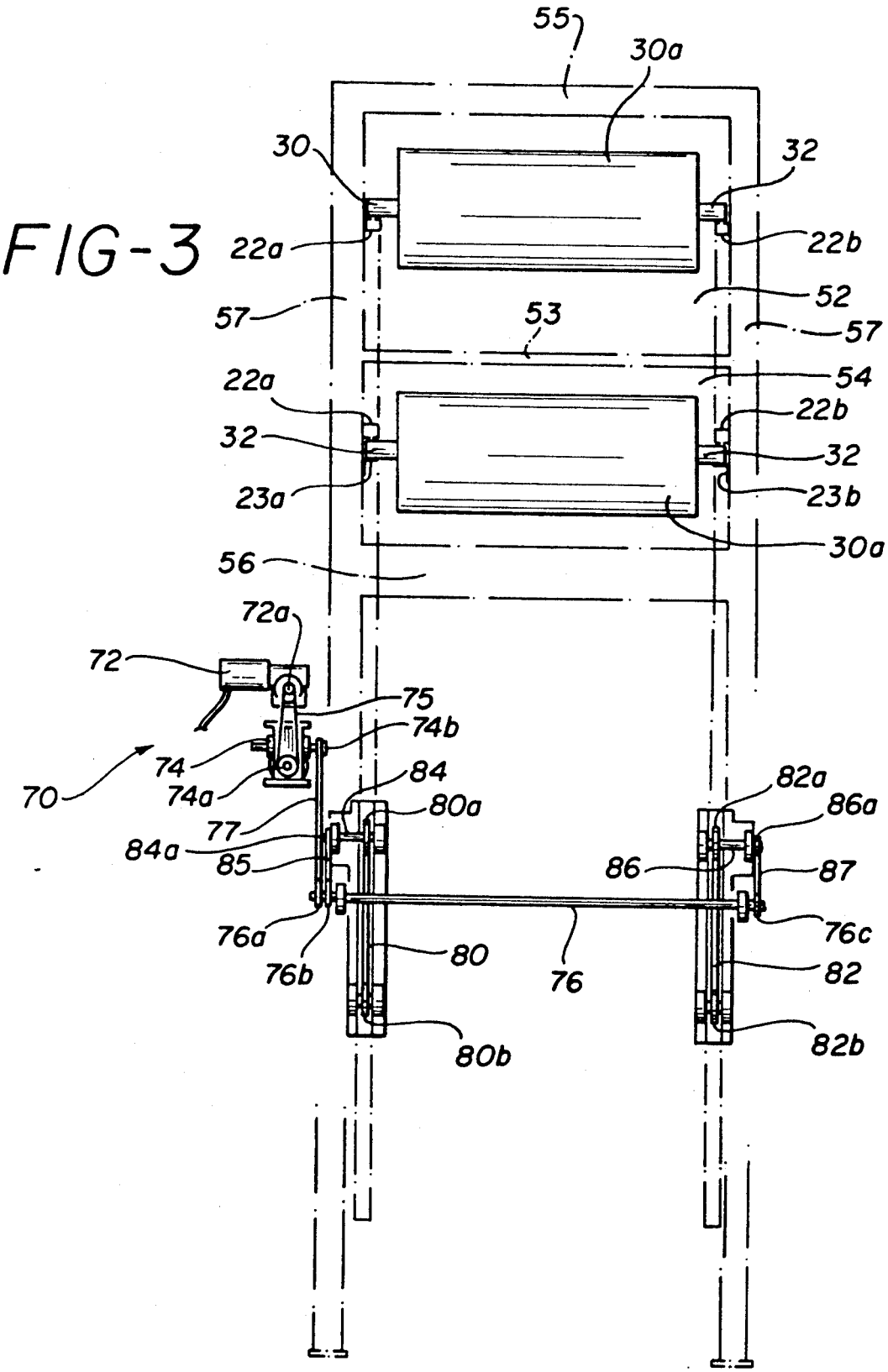
FIG. 3 is a cross-sectional view taken along line 3—3 of FIG. 1.
Figure 4:
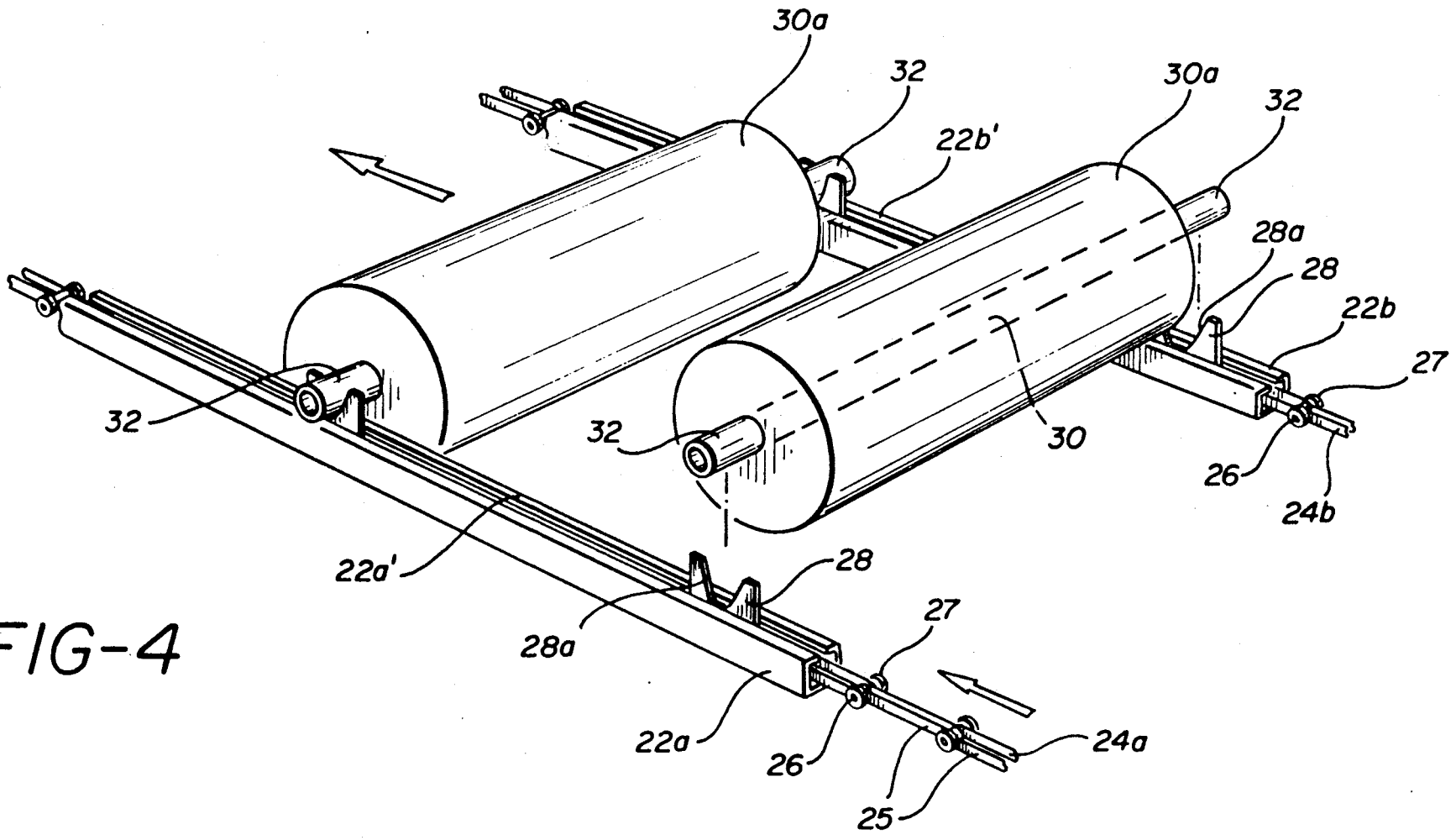
FIG. 4 is an enlarged perspective view of a portion of the conveyor means having two fixtures mounted thereto.
Figure 5:
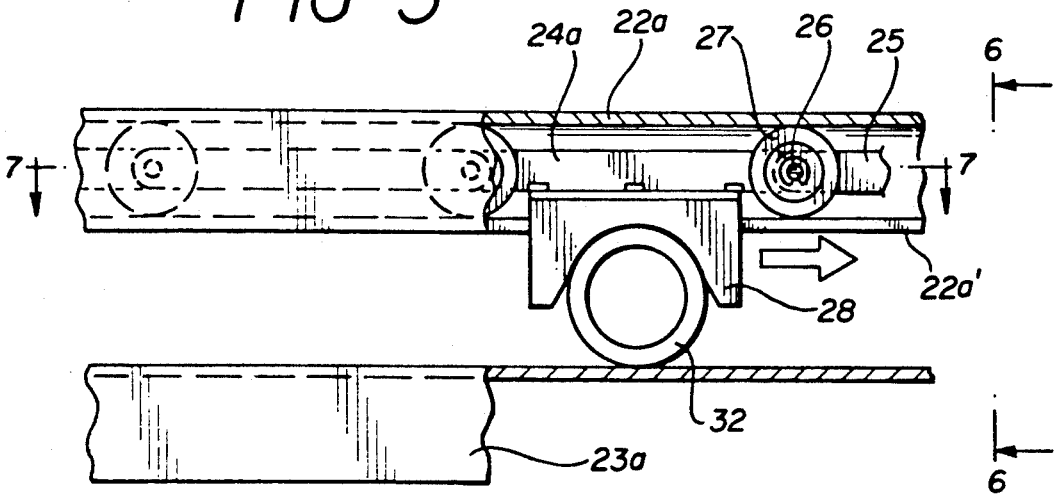
FIG. 5 is an enlarged view, partially in section, of a portion of the conveyor means of the present invention.
Figure 6:
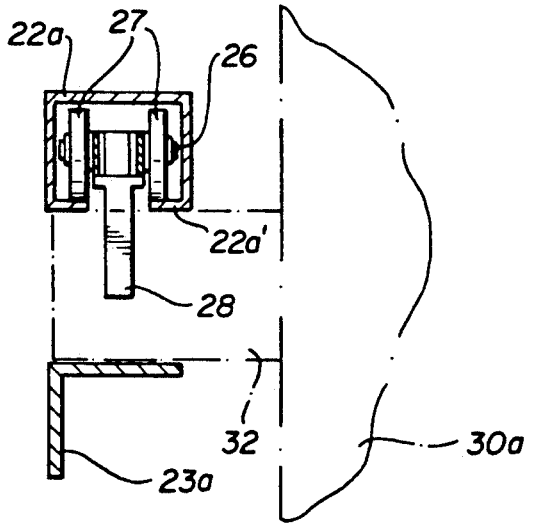
FIG. 6 is a side view, partially in cross-section, taken along line 6—6 of FIG. 5.
Figure 7:
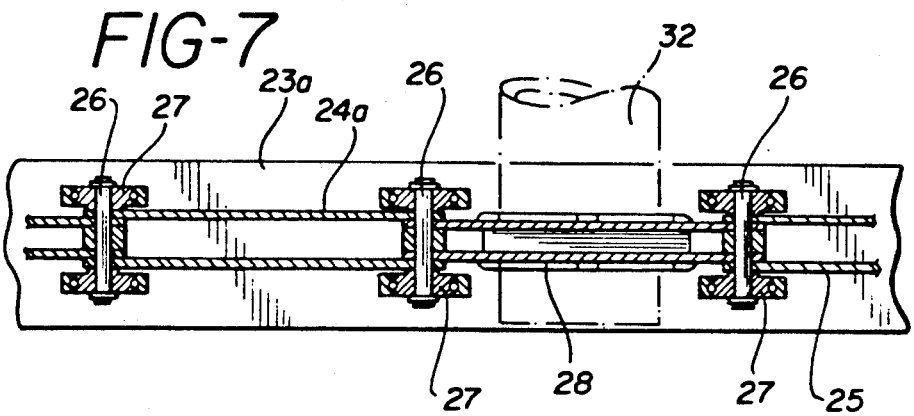
FIG. 7 is a cross-sectional view taken along line 7—7 of FIG. 5.
Figure 11:
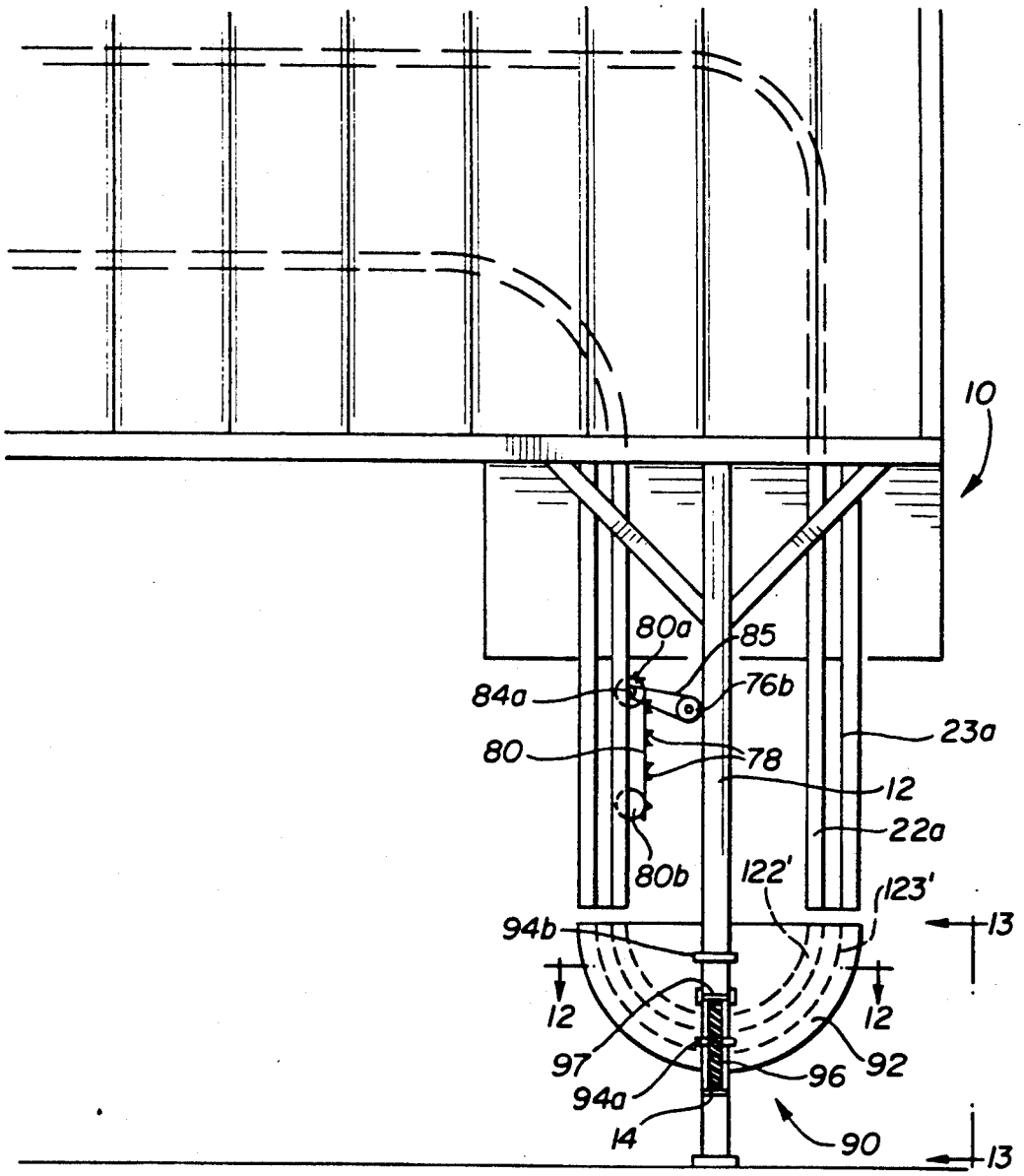
FIG. 11 is an enlarged view of a portion of the conveyor means shown in FIG. 1, and illustrating one of the conveyor chain tensioning means of the conveyor drive means with the conveyor drive motor removed.

The conveyor means 20 additionally includes a conveyor drive means 70, best shown in FIG. 3, which serves to move the endless conveyor chains 24a and 24b through the track sections 22a and 22b. The conveyor drive means 70 comprises a brake-motor-gear-reducer unit 72 which is drivenly connected to a further gear reducer 74 by way of sprockets 72a and 74a and a drive chain 75 extending therearound. A conveyor drive shaft 76 is further provided and is drivenly connected to the gear reducer 74 by way of sprockets 74b and 76a and a chain 77 extending therearound. The drive shaft 76, upon being driven by the motor unit 72, serves to rotate two endless drive chains 80 and 82 which act to engage and move the conveyor chains 24a and 24b through the track sections 22a and 22b. The first drive chain 80 extends about two sprockets 80a and 80b, while the second drive chain 82 extends about two sprockets 82a and 82b. Sprockets 80a 82a are mounted upon shafts 84 and 86, respectively. The drive shaft 76 acts to rotate shaft 84 so as to drive the first drive chain 80 by rotating a drive chain 85 which extends about sprockets 76b and 84a, and acts to rotate shaft 86 so as to drive the second drive chain 82 by rotating a drive chain 87 which rotates about sprockets 76c and 86a. As shown in FIG. 11, each of the endless drive chains 80 and 82 includes engaging teeth or yokes 78 fixedly positioned thereon which serve to engage the pins 26 of the conveyor chains 24a and 24b to move the conveyor chains 24a and 24b through the track sections 22a and 22b.

Because the bottom radius of each yoke 28 extends below the upper portion 22a' or 22b' of its associated track section 22a or 22b, the weight of the fixtures 30 is substantially supported upon the top portions 22a' and 22b' of the track sections 22a and 22b as the fixtures 30 pass through the preheating station 52. Likewise, as the fixtures 30 pass through the curing station 54, the weight of the fixtures 30 is substantially supported on the support tracks 23a and 23b. As a result, the yokes 28 act to push rather that carry the fixtures 30 through the stations 52 and 54. For this reason, the power requirement for the conveyor drive means 70 to move the chains 24a and 24b through the track sections 22a and 22b is substantially reduced.

Figure 12:
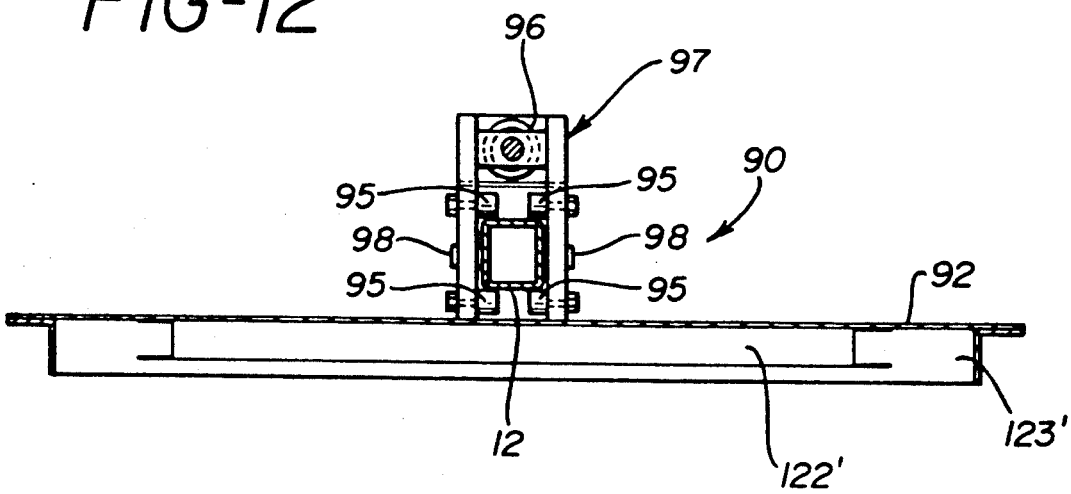
FIG. 12 is a cross-sectional view taken along line 12—12 of FIG. 11.
Figure 13:
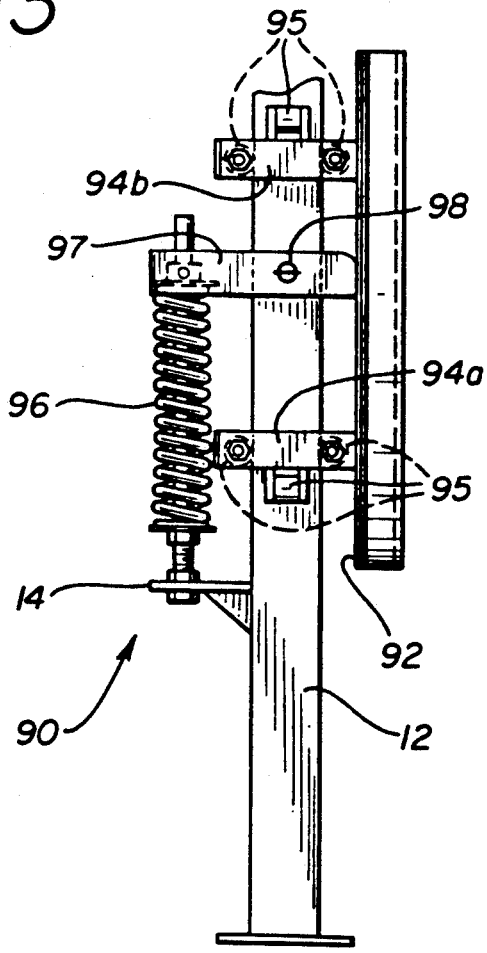
FIG. 13 is a side-view taken along line 13—13 of FIG. 11.

A conveyor chain tensioning means 90, shown in FIGS. 11-13, is associated with each track section 22a and 22b for maintaining the conveyor chains 24a and 24b under substantially constant tension. Each tensioning means 90 comprises a plate 92 which supports a portion 122' of its associated track section 22a or 22b, and a section 123' of its associated article support track 23a or 23b. The support plate 90 is slidably mounted onto a fixed support post 12 of the apparatus 10 by two brackets 94a and 94b. Each of the brackets 94a and 94b includes a plurality of follower rollers 95 associated therewith, which serve to allow the brackets 94a and 94b to move easily along the support post 12. A pivotable lever mechanism 97 is provided and is pivotably mounted to the support post 12 by pivot pins 98. The lever mechanism 97 is fixed at one end to the support plate 92 and is connected at its opposite end to a compression spring 96. The spring 96 is mounted upon a bracket 14 and serves to apply an upwardly directed force upon the lever mechanism 97 causing the mechanism 97 to pivot about pins 98 to apply a downwardly directed force upon the plate 92, thereby applying constant tension to its associated conveyor chain 24a or 24b.

The transfer means 60, which serves to successively transfer each of the fixtures 30 from the endless conveyor means 20 to the first processing station 50, and return each of the fixtures 30 from the first processing station 50 to the conveyor means 20, will now be discussed in detail. The transfer means 60 comprises a reciprocating elevator means 100 which is movable up and down in a direction along a Z-axis, as represented by arrows 102 in FIGS. 15, 19 and 20. Supported upon the elevator means 100 by first and second reciprocating means 120 and 130, respectfully, is a carriage means 140. The carriage means 140 mounts a chuck means 160 thereon which serves to engage with each of the fixtures 30, so as to permit each fixture 30 to be transferred from the conveyor means 20 to the first processing station 50, and returned from the first processing station 50 back to the conveyor means 20.

Figure 16:
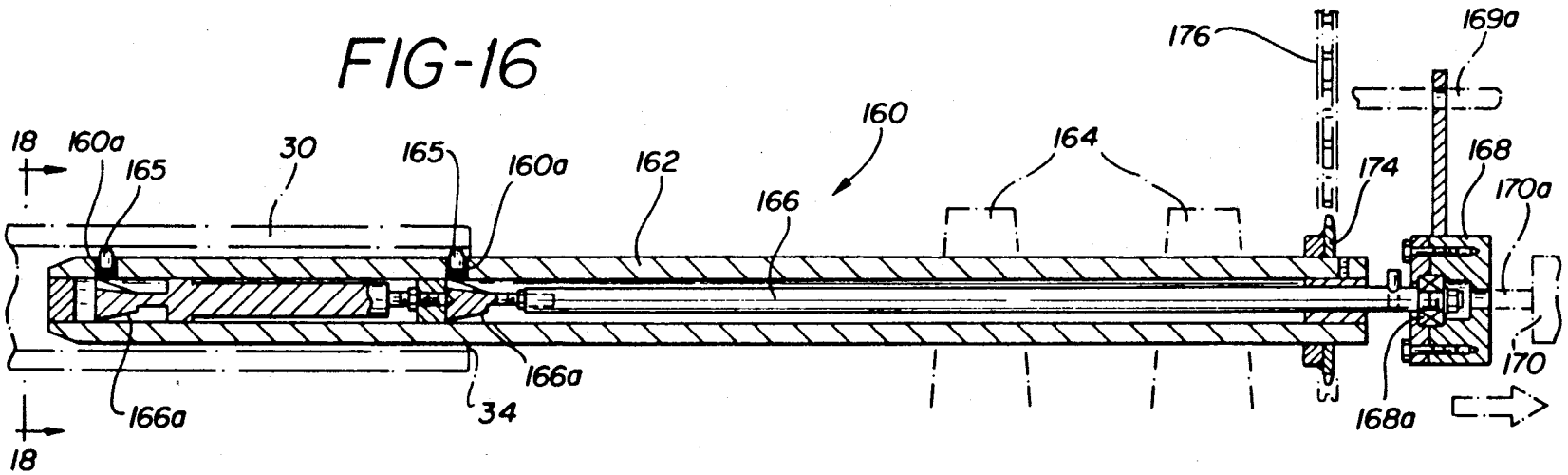
FIG. 16 is a cross-sectional side view of the chuck means of the present invention.
Figure 18:
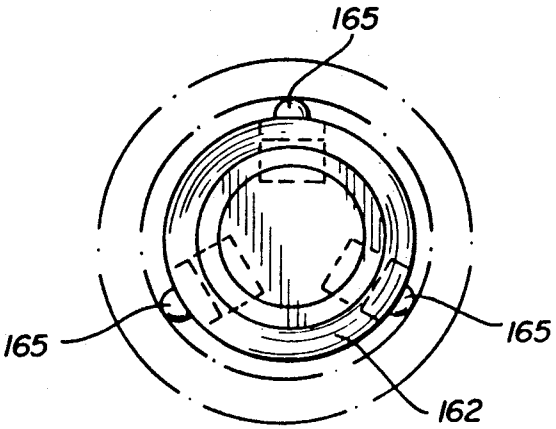
FIG. 18 is an end view of the chuck means taken along line 18—18 of FIG. 16.
Figure 17:
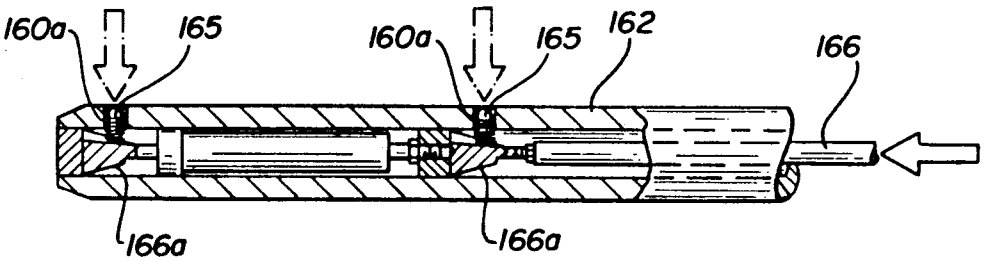
FIG. 17 is a partially cross-sectional view of the chuck means shown in FIG. 16.
Figure 19:
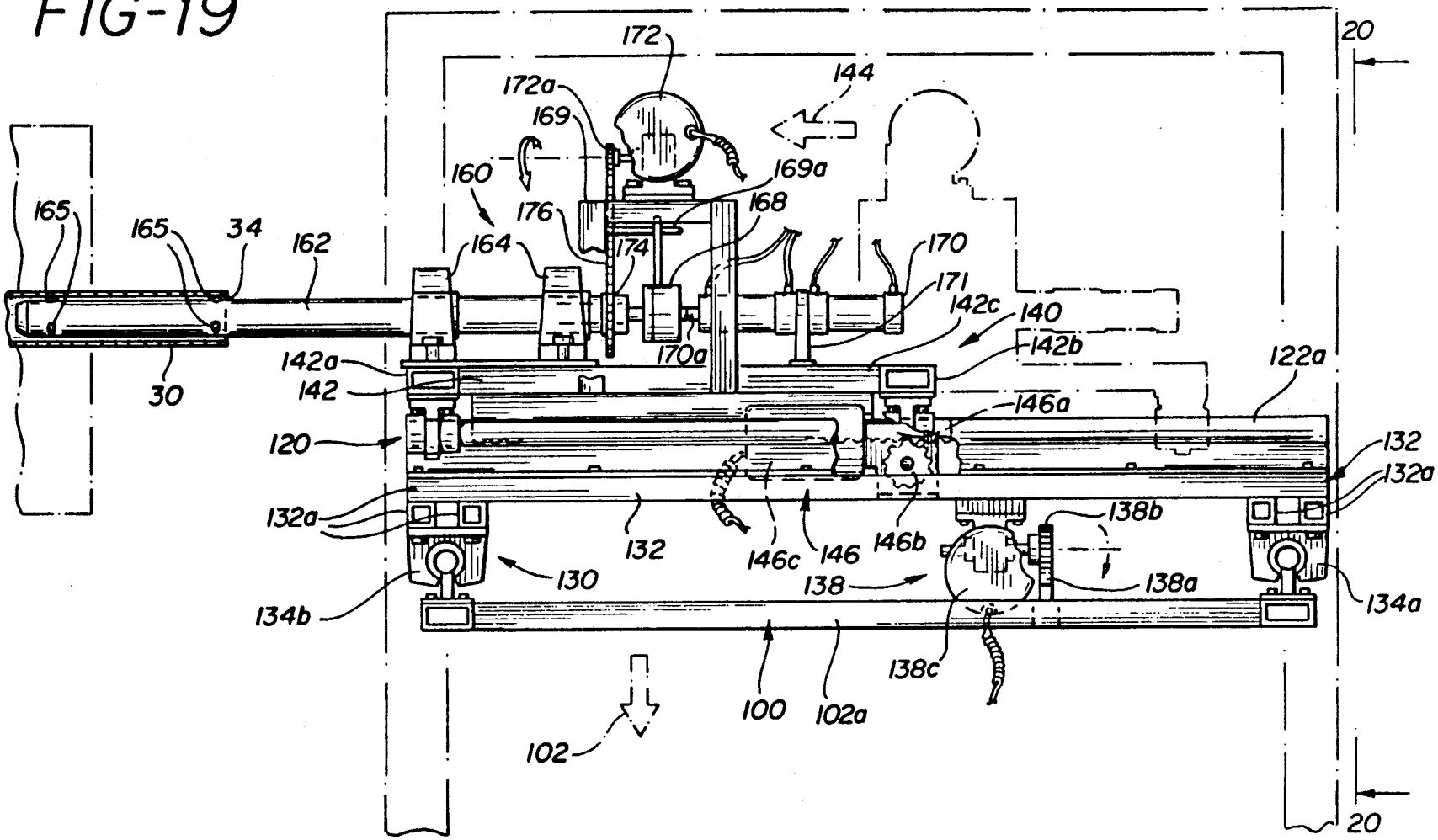
FIG. 19 is a side view of the first and second means, the carriage means and the chuck means of the present invention.

The chuck means 160, shown best in FIGS. 16–18, comprises a hollow chuck or mandrel 162, which is rotatably mounted within bearing blocks 164. The bearing blocks 164 are mounted upon the carriage means 140. The hollow mandrel 162 is insertable within an opening 34 of each fixture 30. A plurality spring-biased detents 165 are located within openings 160a in the mandrel 162 and act to frictionally engage with and lock a fixture 30 onto the mandrel 162 after the mandrel 162 has been inserted within the fixture 30 A reciprocating piston 166 having two camming surfaces 166a is provided within the hollow mandrel 162 and serves to urge the detents 165 into engagement with the fixture 30. The piston 166 is connected at one end to a reciprocating support block 168, which is supported for reciprocating movement upon a rod-like support member 169a of a support frame 169, as shown in FIG. 19. A bearing 168a is provided within the block 168 and serves to allow the piston 166 to rotate with the mandrel 162. An air-over-hydraulic-cylinder motor 170 having a piston 170a threadedly connected to the block 168 is mounted upon a support 171 The cylinder 170 serves to reciprocate the piston 166 back and forth within the mandrel 162 so as to permit the camming surfaces 166a of the piston 166 to urge the detents 165 into engagement with the fixture 30 or to release the detents 165 from engagement with the fixture 30.

A drive motor 172 having a drive sprocket 172a is located upon the support frame 169, as shown in FIG. 19, and acts to rotate the mandrel 162 about its longitudinal axis. A drive sprocket 174 is fixedly mounted to the mandrel 162, and a chain 176 extends about the sprockets 172a and 174 for transferring rotational motion from the drive motor 172 to the mandrel 162.

Figure 20:
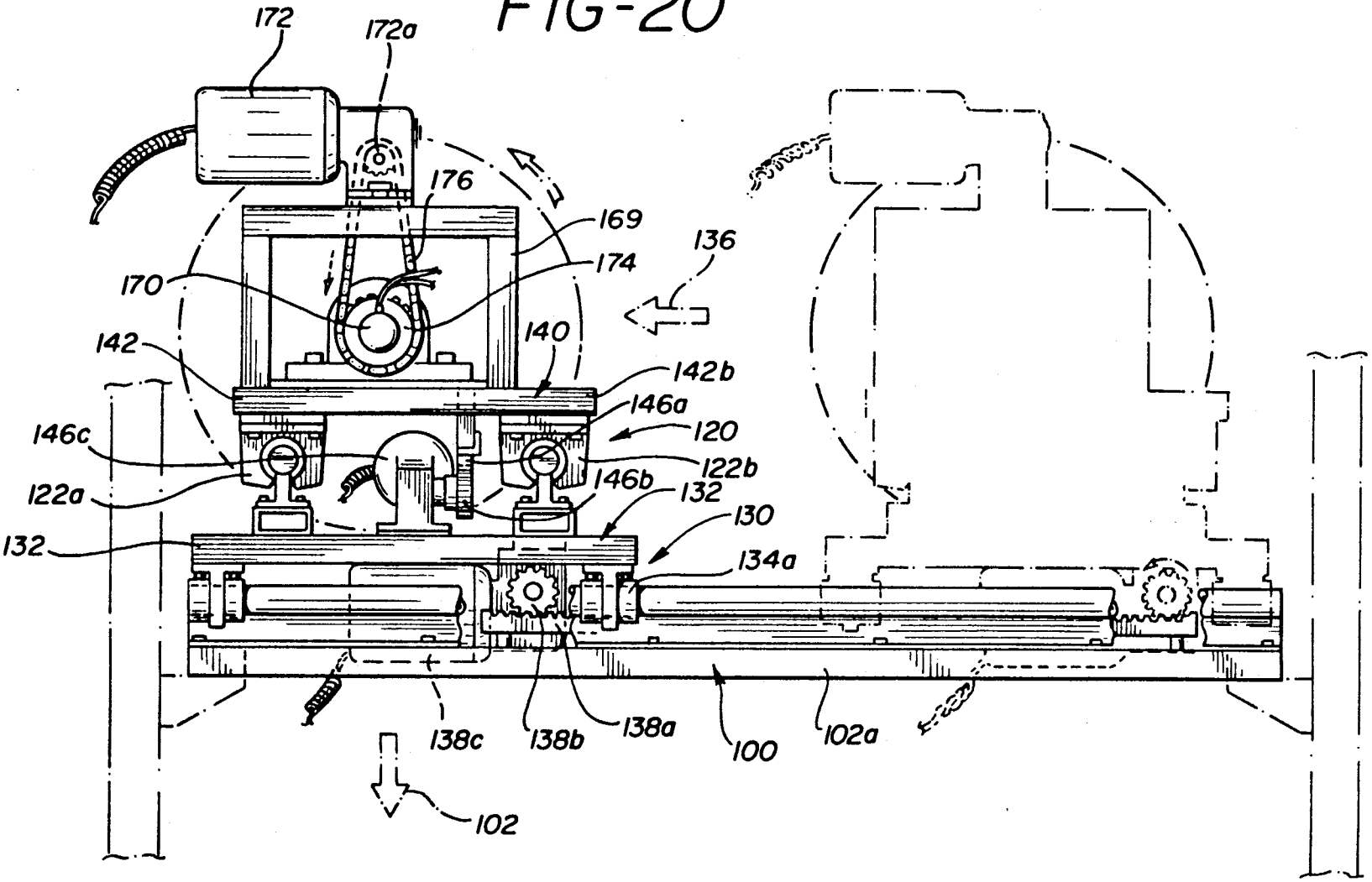
FIG. 20 is an end view of the first and second reciprocating means, the carriage means and the chuck means of the present invention.

Referring to FIGS. 19 and 20, the carriage means 140 comprises a frame 142 made from two end rails 142a and 142b weldably connected to a center rail 142c. The frame serves 142 to fixedly support the chuck means 160 thereon including the bearing blocks 164, the support frame 169, and the motor support 171. The carriage means 140 also serves to move the chuck means 160 along X, Y and Z axes so as to permit the chuck means 140 to engage with and transfer each of the fixtures 30 from the conveyor means 20 to the first processing station 50, and return each of the fixtures 30 from the first processing station 50 to the conveyor means 20.

As discussed above, the first and second reciprocating means 120 and 130, respectively, serve to mount the carriage means 140 on the elevator means 100. The first reciprocating means 120 comprises two linear bearings 122a and 122b which are fixedly connected at their opposite ends to the frame 142 and the second reciprocating means 130 by bolts or the like. The two linear bearings 122a and 122b serve to allow the frame 142 and the carriage means 140 to move from an initial position, shown in phantom in FIG. 19, toward the elevator means 100 in a direction, represented by arrow 144, along the X-axis. The linear bearings 122a and 122b also allow the frame 142 to return to its initial position. A rack and pinion motor arrangement 146 is provided to move the frame 142 back and forth on the two linear bearings 122a and 122b along the X-axis. A rack 146a is fixedly connected to the frame 142 and is drivenly connected to a drive pinion 146b of a drive motor 146c, which is mounted to the second reciprocating means 130. The rack 146a and the pinion 146b act together to reciprocate the carriage back and forth along the linear bearings 122a and 122b in the X-direction.

The second reciprocating means 130 comprises a frame 132 upon which the first reciprocating means 120 is mounted. The frame 132 is constructed from weldably connected rails 132a. Two linear bearing 134a and 134b are further provided and are fixedly connected at their opposite ends to the frame 132 and to the elevator means 100 by bolts or the like. The two linear bearings 134a and 134b serve to allow the frame 132, the first reciprocating means 120 and the carriage means 140 to move from a first position, shown in phantom in FIG. 20, away from the conveyor means 20 in a direction, represented by arrow 136, along the Y-axis. The linear bearings 134a and 134b also allow the frame 132 to return to its first position. A rack and pinion motor arrangement 138 is provided to move the frame 132 back and forth along the two linear bearings 134a and 134b in the Y-direction. A rack 138a is fixedly connected to the elevator means 100 and is drivenly connected to a drive pinion 138b of a drive motor 138c, which is mounted to the frame 132. The rack 138a and the pinion 138b act together to reciprocate the frame 132 and the carriage means 140 back and forth along the linear bearings 134a and 134b in the Y-direction.

Figure 14:
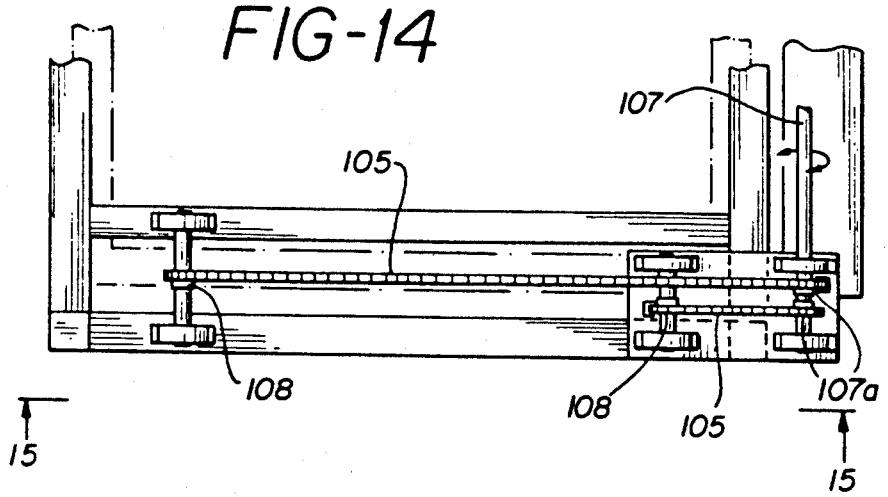
FIG. 14 is a top view of a portion of the transporting apparatus taken along line 14—14 of FIG. 1.
Figure 15:
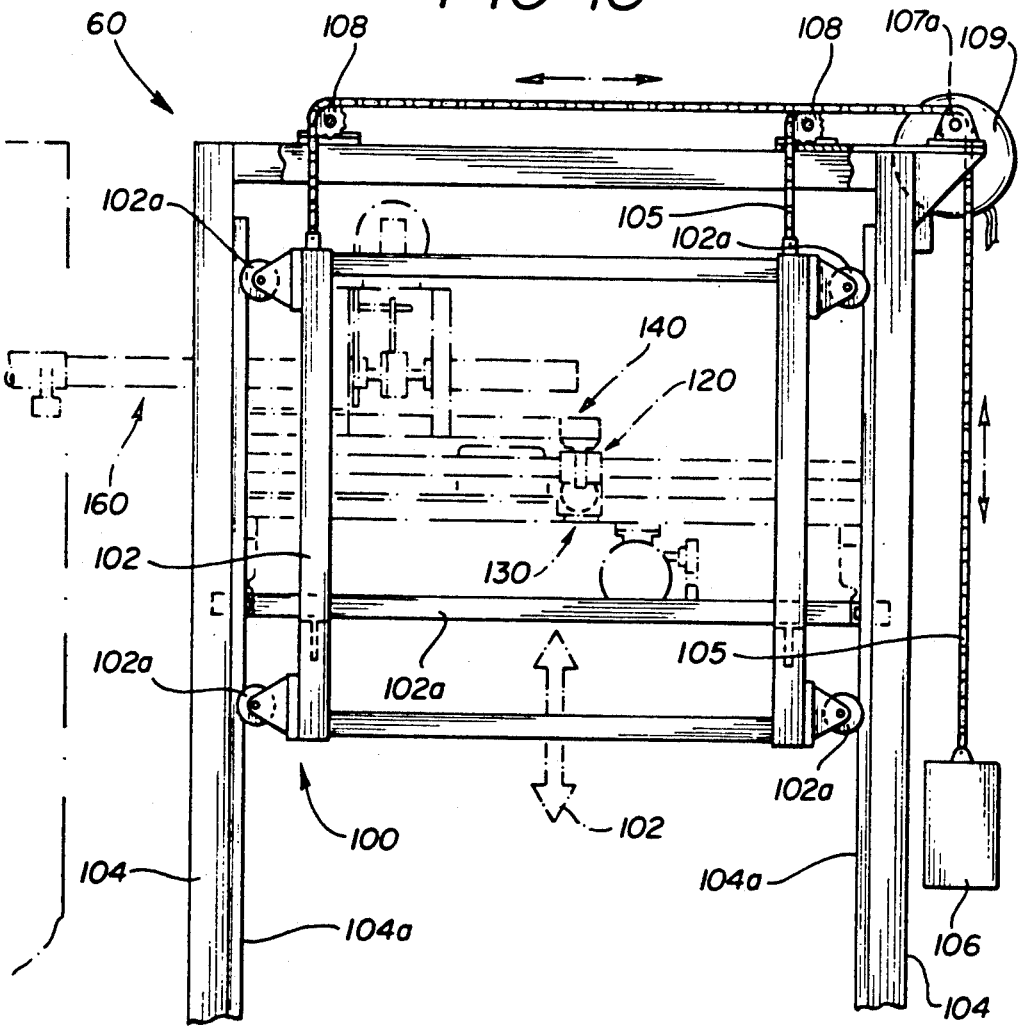
FIG. 15 is a side elevational view taken along line 15—15 of FIG. 14 showing the elevator means and, in phantom, the first and second reciprocating means, the carriage means and the chuck means.
Figure 21:
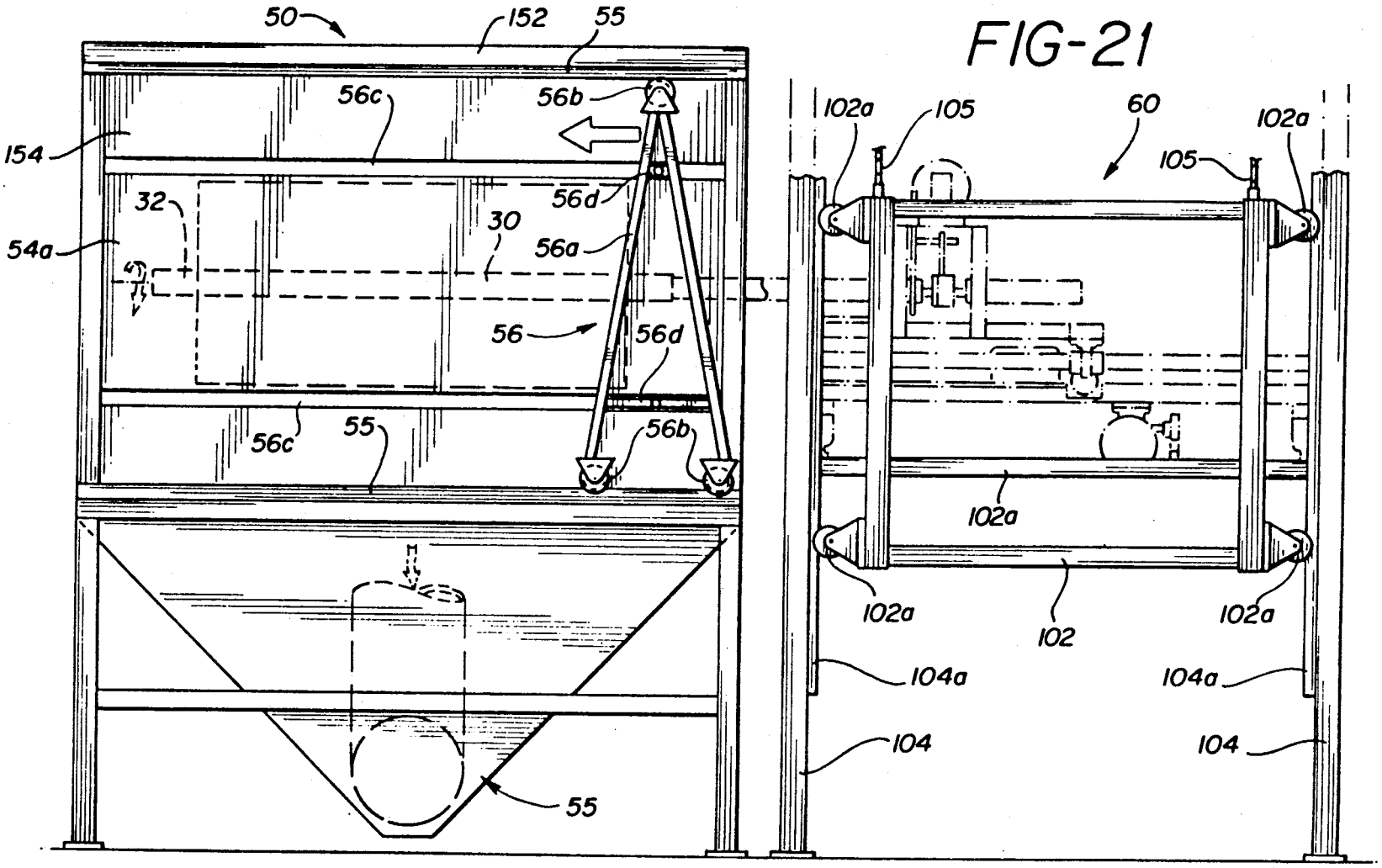
FIG. 21 is a side elevational view of the first processing station and the transfer means of the present invention.

Referring to FIGS. 14, 15 and 21, the elevator means 100 comprises a reciprocating frame 102 having rollers 102a thereon whi[illegible] travel along corresponding rails 104a mounted on a fixed frame 104. The frame 102 includes a support table 102a, which is fixedly connected to the second reciprocating means 130, and serves to support the first and second reciprocating means 120 and 130, the carriage means 140 and the chuck means 160 thereon for movement along the Z-axis. The frame 102 is connected by four chains 105 to a counterweight 106. The chains 105 extend from the counterweight 106 over drive sprockets 107a fixedly mounted on a drive shaft 107 and over corresponding sprockets 108 before connecting with the frame 102. The drive shaft 107 is connected to a brake motor 109, shown in FIGS. 1 and 15. The brake motor 109 serves to rotate the drive shaft 107 so as to permit the frame 102 to move in a direction along the Z-axis, as represented by arrows 102, toward and away from the first portion 42 of the conveying path 40.

As mentioned above, the first processing station 50 may comprise an electrostatic powder coating spray station 152, shown best in FIG. 21. The station 152 comprises a spray booth 154 which is enclosed by four side walls 54a. Positioned below the side walls 54a is an exhaust device 55 which serves to pull air from the booth 154 so as to remove excess powder coating material therefrom. Two of the four side walls 54a include a spray mechanism 56 associated therewith. Each spray mechanism 56 comprises a reciprocating frame 56a having three rollers 56b connected thereto which travel along support rails 55 mounted upon one of the side walls 54a. The frame 56a includes two spray gun supports 56b, each of which extends through a corresponding opening 56c in the side wall 54a and mounts a spray gun 56d (shown schematically in FIG. 2) inside the spray booth 54a. The spray mechanism 56 serve to spray powder coating material onto workpieces 30a mounted on a fixture 30 after the fixture 30 has been lowered into the spray booth 154 by the transfer means 60, as shown in FIG. 21.

Figure 22:
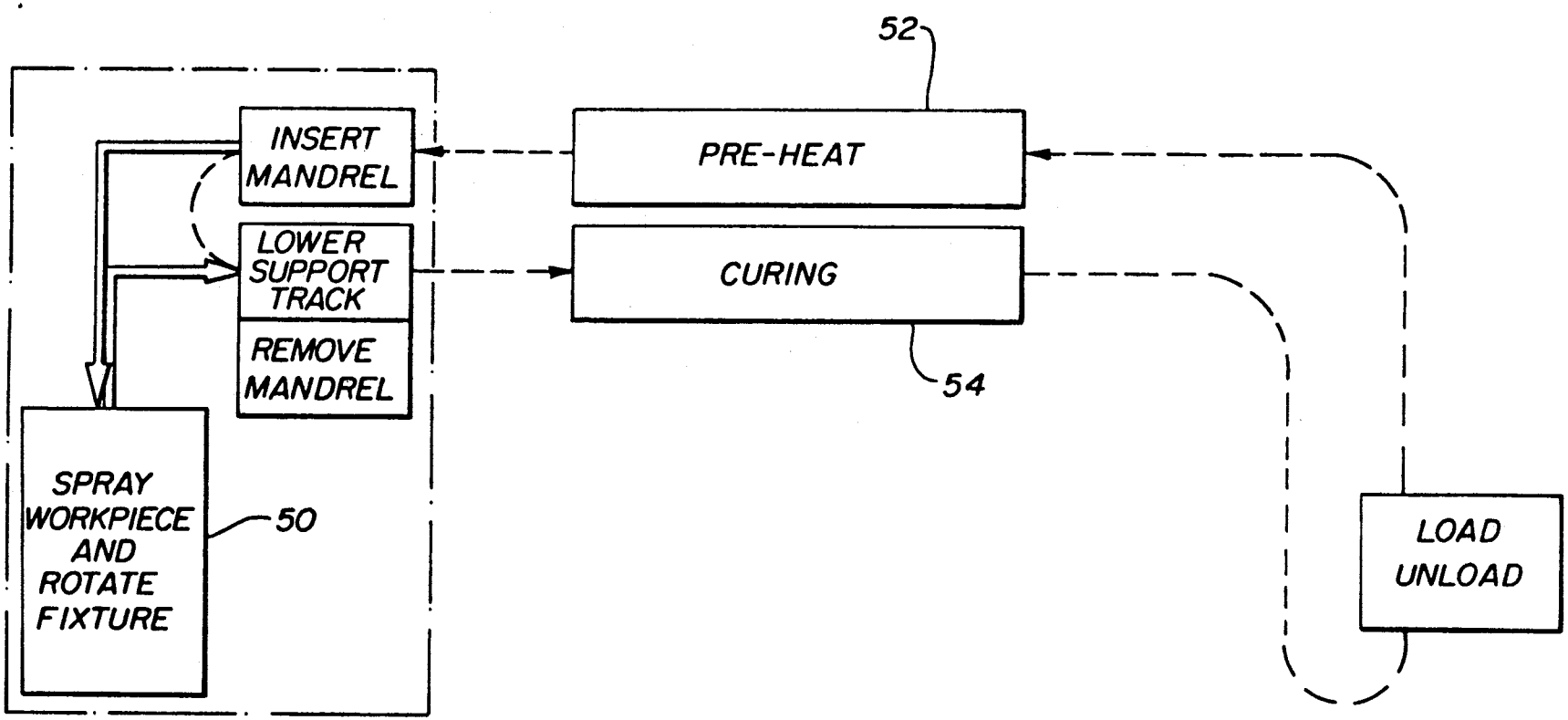
FIG. 22 is a block diagram showing the operation of the transporting apparatus of the present invention.

The operation of the transporting apparatus 10 will now be explained. As shown in FIG. 22, the fixtures 30 are initially loaded onto the conveyor means 20 at a load/unload station. The conveyor means 20 moves the fixtures 30 along the second section 44 of the conveying path 40, through the preheat station 52, and up to a point A on the conveying path 40, as shown in FIG. 2. When each fixture 30 reaches point A, the transfer means 60 acts to engage with the fixture 30 at that point, transfer the fixture 30 into the first processing station 50, and return the fixture 30 to the conveyor means 20 after the workpieces 30a on the fixture 30 have been acted upon in the processing station 50. The fixture 30 is returned the conveyor means 20 at a point C on the conveying path, shown in FIG. 2. Thereafter, the conveyor means 20 transfers the fixture 30 through the curing station 54 and back to the load/unload station.

When the transfer means 60 acts to remove the fixture 30 from the conveyor means 20 at point A, the elevator means 100 is first lifted upwardly in the Z-direction by way of the motor 108 to an elevation which permits the mandrel 162 to enter into the fixture 30. Motor 146c then causes the carriage means 140 to move along the linear bearings 122a and 122b in the X-direction, so as to permit the mandrel 162 to enter into the fixture 30. Thereafter, the elevator means 100 is caused to move upwardly in the Z-direction once again, so as to permit the mandrel 162 to lift the fixture 30 from the yoke 28 at point A. Motor 138c thereafter causes the carriage means 140 to move in the Y-direction, so as to permit the mandrel 162 to move along a slot 57a in one of the side plates 57, shown in FIG. 1, in order to position the fixture 30 just above the spray station 152. Thereafter, the elevator means 100 is lowered in the Z-direction to lower the mandrel 162 and the fixture 30 into the processing station 50, as shown in FIG. 21.

While in the spray station 152, the fixture 30 may be rotated by motor 172 so as to permit the workpieces 30a on the fixture 30 to be completely coated while being sprayed by the spray guns 56d. Rotation of the workpieces 30a in the spray station 152 also serves to minimize runs during and after spraying. After the workpieces 30a have been acted upon in the spray station 152, the elevator means 100 is lifted to an elevation even with a slot 57b, in plate 57. Thereafter, the motor 138c causes the carriage means 140 to move in the Y-direction, so as to permit the mandrel 162 to move along the slot 57b to return the fixture 30 to the conveyor means 20. It is noted, that from the time that the fixture 30 is taken from point A until it is returned to point C, the conveyor means 20 moves the yoke 28 initially at point A to only point B.

Alternatively, after spraying, the elevator means 100 may be lifted to a point above slot 57b. If the pre-heating station 52 is maintained at a higher temperature than the curing station 54, raising the elevator means 100 above slot 57b for a predetermined amount of time allows the workpieces 30a on the fixture 30 to be heated at an elevated temperature before passing through the curing station 54. Thereafter, the elevator means 100 is lowered so as to be even with slot 57b so that the fixture 30 can be returned to the conveyor means 20.

As the fixture 30 is being returned to the conveyor means 20, cylinder 188 causes sections 23' of support tracks 23a and 23b to pivot downwardly, as shown in phantom in FIG. 2. After the fixture 30 has been placed in the yoke 28 at point C, the cylinder 188 then causes sections 23' to pivot upwardly, thereby re-mounting the fixture 30 onto the conveyor means 20. Motor 146c then causes the carriage means 140 to move along the linear bearings 122a and 122b in the X-direction, so as to permit the mandrel 162 to exit the fixture 30. The transfer means 60 repeats the above-described cycle for each fixture 30 on the conveyor means 20.

A controller, such as an "SY/MAX" programmable controller sold by Square D Corp., may be provided and mounted in a housing 200, shown in FIG. 1, to control each of the motors and cylinders disclosed above. By use of the controller, the speed of the conveyor means 20, the rotational speed of the mandrel 162 and the speed of the transfer means 60 may be varied to optimize the rate of coating of articles 30 in the spraying station 152 and to optimize coating quality.

Having thus described the transporting apparatus of the present invention in detail and by reference to a preferred embodiment thereof, it will be apparent that modifications and variations are possible without departing from the scope of the invention defined in the appended claims.

What is claimed is:

1. Apparatus for transporting articles which are acted upon in at least one processing station comprising:

a plurality of fixtures each for supporting at least one article thereon;

endless conveyor means for conveying each of said fixtures along a predetermined conveying path, a first section of said conveying path being positioned proximate to a first processing station;

transfer means positioned adjacent to said first section of said conveying path for successively transferring each of said fixtures from said endless conveyor means to said first processing station to permit said article supported upon each fixture to be acted upon in said processing station, and returning each of said fixtures from said processing station to said conveyor means after said article on each fixture has been acted upon in said processing station, said transfer means comprising chuck means for engaging with and transferring each of said fixtures successively from said endless conveyor means to said first processing station, and returning each of said fixtures from said first processing station to said conveyor means, carriage means for supporting said chuck means and moving said chuck means along first, second and third mutually perpendicular axes so as to permit said chuck means to engage with and transfer each of said fixtures from said conveyor means to said first processing station, and return each of said fixtures from said first processing station to said conveyor means, first reciprocating means connected to said carriage means for moving said carriage means along said first axis, second reciprocating means connected to said first reciprocating means for moving said first reciprocating means and said carriage means along said second axis, and elevator means connected to said second reciprocating means for moving said first and second reciprocating means and said carriage means along said third axis.

2. Apparatus as defined in claim 1, wherein said first processing station comprises a spraying station.

3. Apparatus as defined in claim 2, further comprising second and third processing stations.

4. Apparatus as defined in claim 3, wherein said second processing station comprises a pre-heating station and said third processing station comprises a curing station.

5. Apparatus as defined in claim 4, wherein said conveying path further includes a second section which extends through said pre-heating station and a third section which extends through said curing station.

6. Apparatus as defined in claim 1, wherein said first reciprocating means comprises first linear bearing means connected to said carriage means for supporting said carriage means and allowing said carriage means to reciprocate back and forth along said first axis, and first rack and pinion drive means for reciprocating said carriage means back and forth along said first linear bearing means.

7. Apparatus as defined in claim 1, wherein said second reciprocating means comprises second linear bearing means for supporting said first reciprocating means and said carriage means and allowing said first reciprocating means and said carriage means to reciprocate back and forth along said second axis, and second rack and pinion drive means for reciprocating said first reciprocating means and said carriage means back and forth along said second linear bearing means.

8. Apparatus as defined in claim 1, wherein said elevator means comprises a frame connected to said second reciprocating means for supporting said first and second reciprocating means and said carriage means, and drive means connected to said frame for reciprocating said frame, said first and second reciprocating means and said carriage means back and forth along said third axis.

9. Apparatus as defined in claim 1, wherein said chuck means comprises a mandrel having a centrally located longitudinal axis, and means associated with said mandrel for locking one of said fixtures thereto.

10. Apparatus as defined in claim 9, wherein said transfer means further comprises means for rotating said mandrel about its centrally located longitudinal axis.

11. Apparatus as defined in claim 1, wherein said conveyor means comprises an endless conveyor chain, and means for transferring said endless conveyor chain along said conveying path.

12. Apparatus for transporting articles which are acted upon in at least one processing station comprising:

a plurality of fixtures each for supporting at least one article thereon;

endless conveyor means for conveying each of said fixtures along a conveying path, a first section of said conveying path being positioned proximate to a first processing station;

transfer means positioned adjacent to said first section of said conveying path for transferring each of said fixtures one at a time from said endless conveyor means to said first processing station to permit said article supported upon each respective fixture to be acted upon in said processing station, and returning each of said fixtures from said processing station to said conveyor means after said article on each respective fixture has been acted upon at said processing station, said transfer means comprising chuck means for engaging with and transferring each of said fixtures one at a time from said endless conveyor means to said first processing station, and returning each of said fixtures from said first processing station to said conveyor means, carriage means for supporting said chuck means and moving said chuck means along first, second and third mutually perpendicular axes so as to permit said chuck means to engage with and transfer each of said fixtures from said endless conveyor means to said first processing station, and return each of said fixtures from said first processing station to said conveyor means, first reciprocating means connected to said carriage means for moving said carriage means along said first axis, second reciprocating means connected to said first reciprocating means for moving said first reciprocating means and said carriage means along said second axis, and elevator means connected to said second reciprocating means for moving said first and second reciprocating means and said carriage means along said third axis.

13. An apparatus as defined in claim 12, wherein said first processing station comprises a spraying station.

14. An apparatus as defined in claim 13, further comprising second and third processing stations.

15. Apparatus as defined in claim 14, wherein said second processing station comprises a pre-heating station and said third processing station comprises a curing station.

16. An apparatus as defined in claim 15, wherein said conveying path further includes a second section which extends through said pre-heating station and a third section which extends through said curing station.

17. An apparatus as defined in claim 12, wherein said first reciprocating means comprises first linear bearing means connected to said carriage means for supporting said carriage means and allowing said carriage means to reciprocate back and forth along said first axis, and first rack and pinion drive means for reciprocating said carriage means back and forth along said first linear bearing means.

18. An apparatus as defined in claim 12, wherein said second reciprocating means comprises second linear bearing means for supporting said first reciprocating means and said carriage means and allowing said first reciprocating means and said carriage means to reciprocate back and forth along said second axis, and second rack and pinion drive means for reciprocating said first reciprocating means and said carriage means back and forth along said second linear bearing means.

19. An apparatus as defined in claim 12, wherein said elevator means comprises a frame connected to said second reciprocating means for supporting said first and second reciprocating means and said carriage means, and drive means connected to said frame for reciprocating said frame, said first and second reciprocating means and said carriage means back and forth along said third axis.

20. An apparatus as defined in claim 12, wherein said chuck means comprises a mandrel having a centrally located longitudinal axis, and means associated with said mandrel for locking a fixture thereto.

21. An apparatus as defined in claim 20, wherein said transfer means further comprises means for rotating said mandrel about its centrally located longitudinal axis.

22. An apparatus as defined in claim 12, wherein said conveyor means comprises an endless conveyor chain, and means for transferring said endless chain along said conveying path.

* * * * *